US005603826A

United States Patent [19]

Welch

[11] Patent Number: 5,603,826

[45] Date of Patent: Feb. 18, 1997

[54] RETURN PUMP SYSTEM FOR USE WITH CLEAN-IN-PLACE SYSTEM FOR USE WITH VESSELS

[75] Inventor: Elmer S. Welch, Silver Lake, Wis.

[73] Assignee: V Q Corporation, Silver Lake, Wis.

[21] Appl. No.: 601,792

[22] Filed: Feb. 15, 1996

[51] Int. Cl.[6] ..... B08B 9/08

[52] U.S. Cl. ..... 210/195.1; 210/198.1; 210/511; 210/512.1; 134/95.3; 134/108; 134/109; 134/169 R

[58] Field of Search ..... 134/21, 22.14, 134/22.18, 95.3, 108, 109, 160 R; 210/194, 195.1, 198.1, 511, 512.1

[56] References Cited

U.S. PATENT DOCUMENTS

| | | | |
|---|---|---|---|
| 812,855 | 2/1906 | Ljungström . | |
| 1,440,808 | 1/1923 | Wineman . | |
| 3,359,708 | 12/1967 | Barber . | |
| 3,378,018 | 4/1968 | Lawter | 134/109 |
| 3,448,745 | 6/1969 | Seeley . | |
| 3,502,215 | 3/1970 | Cahan | 210/167 |
| 3,575,729 | 4/1971 | Howard . | |
| 3,719,191 | 3/1973 | Zimmerly . | |
| 3,771,290 | 11/1973 | Stethem . | |
| 3,996,027 | 1/1976 | Schnell et al. . | |
| 4,171,710 | 10/1979 | Boynton et al. | 137/238 |
| 4,202,364 | 5/1980 | Karr | 137/13 |
| 4,363,641 | 12/1982 | Finn, III . | |
| 4,481,086 | 11/1984 | Bianchi et al. | 204/78 |
| 4,555,253 | 11/1985 | Hull et al. . | |
| 4,895,603 | 1/1990 | Semp et al. | 134/21 |
| 4,941,593 | 7/1990 | Hicks | 222/148 |
| 5,107,874 | 4/1992 | Flanigan et al. | 134/60 |
| 5,392,797 | 2/1995 | Welch | 134/108 |
| 5,398,733 | 3/1995 | Welch | 141/4 |

FOREIGN PATENT DOCUMENTS

| | | |
|---|---|---|
| 1498403 | 2/1969 | Germany . |
| 710672 | 2/1980 | U.S.S.R. . |
| 761035 | 9/1980 | U.S.S.R. . |

OTHER PUBLICATIONS

Sani–Matic Systems Brochure (2 pages, undated).

Tri–Flo Clean–In–Place Systems Brochure, 12 pages, Ladish Co. (1980/1984).

2–page Article, "Jet Pumps" by John A. Reynolds (Undated).

3–page Article, "Jet Pump Technical Data Pumping Liquids" by Penberthy (Bulletin 1200, Issued May 1987).

*Primary Examiner*—David A. Reifsnyder

*Attorney, Agent, or Firm*—Dressler, Goldsmith, Milnamow & Katz, Ltd.

[57] ABSTRACT

A self-cleaning return pump system for use with a clean-in-place system for cleaning vessels includes a recirculation loop for providing flow communication including a return pump, an eductor, and a separator. The return pump is arranged to discharge a liquid through the eductor into the separator and is supplied with a substantially continuous flow of liquid from the separator. A return line provides flow communication between the vessel to be cleaned and a suction port of the eductor. The separator has a top discharge port and a bottom discharge port. The top discharge port is configured to discharge a liquid or a liquid-air mixture therefrom to the clean-in-place system. The return pump causes liquid flowing through the recirculation loop at the eductor to have sufficient dynamic head to draw liquid or a mixture of liquid and air from the vessel through the return line, into the eductor. The liquid or liquid air mixture is discharged into the separator. The bottom discharge port of the separator provides the substantially continuous flow of liquid to the return pump and substantially all of the air and a portion of the liquid is discharged from the separator top discharge port at a flow rate sufficiently high to maintain a flow of liquid across the bottom of the vessel to maintain the liquid therein in a state of substantially continuous flow. The liquid is discharged from the separator top discharge port at a rate of flow about equal to the rate of flow of liquid supplied to the vessel through the supply line.

8 Claims, 4 Drawing Sheets

RETURN PUMP SYSTEM FOR USE WITH CLEAN-IN-PLACE SYSTEM FOR USE WITH VESSELS

FIELD OF THE INVENTION

This invention pertains to cleaning systems for in-place cleaning of process vessels, and more particularly, this invention pertains to a return pump system for use with a clean-in-place system, which return pump system improves solution return and is self-cleaning.

BACKGROUND OF THE INVENTION

Strict regulatory requirements govern process vessel and piping system cleanliness in many industries. In certain industries, such as the food processing industry, dairy industry, pharmaceutical industry, and the like, vessel and system cleaning must be performed regularly or daily to meet strict regulatory requirements. In addition, in these industries as well as others, vessels and piping systems may also require periodic cleaning to perform maintenance on the vessels or systems, or subsequent to performing maintenance thereon, prior to placing such systems into operation.

To meet such cleanliness requirements in the most effective and cost efficient manner, many facilities, and in particular processing facilities which require regular or daily cleaning, have installed "clean-in-place" systems. These systems are usually permanent, fixed, "hard-piped" systems which operate to clean process systems quickly and without temporary piping, hoses, pumps, and the like. Moveable equipment and vessels, such as those associated with tank trucks, are typically cleaned using hoses and other partially temporarily assembled systems.

Known clean-in-place systems typically comprise a number of tanks and associated pumps, automatic and manual valves, and interconnecting piping. The systems generally fall into two broad categories, namely, multiple use systems in which the chemical cleaning agent is stored after use and subsequently reused for system cleaning, and single use systems in which the chemical cleaning agent is used once and discarded after use.

Exemplary of the single use type system, is that system disclosed in U.S. Pat. No. 5,392,797 to Welch, which patent is commonly assigned with the present invention and is incorporated herein by reference.

In multiple use systems, often the final rinse solution from one cleaning cycle is stored and the solution is reused as an initial rinse solution in a subsequent cleaning cycle.

Single use systems can be configured as single tank or multi-tank systems. Such systems may include an eductor pump located at the clean-in-place unit to return the cleaning agent to the system or a motive pump return arrangement. An exemplary two tank eductor pump system includes a wash tank, a rinse tank, and a supply pump for supplying wash or rinse liquid to the vessel being washed. The two tank eductor pump system also includes a motive tank in addition to the wash and rinse tanks, and a motive pump to provide dynamic head for the eductor.

The motive supply tank of many such known systems typically has a large liquid surface area which is open to atmosphere to provide adequate surface area and opportunity for the returning solution to release any entrained air. Release of the entrained air in the returning solution is important to prevent air from entering with the feed solution to the motive pump. Air which may otherwise enter with the feed solution could cause the pump to lose prime or suction, and ultimately damage the pump.

In many of the known return systems, the return solution recirculates through the motive supply tank. Moreover, such tanks typically do not have provisions for cleaning, and, as a result, the tanks tend to retain soil and detrimentally transfer the soil to the wash solution later in the cleaning cycle. Other known systems include a spray device installed in the motive tank to clean the tank by use of, and during, an auxiliary cycle.

An exemplary two tank return pump system includes a wash tank, a rinse tank, a supply pump, and return pump. The supply pump supplies the wash or rinse liquid to the vessel to be cleaned and the return pump returns the contaminated liquid from the vessel to the clean-in-place system. Return pump systems are more prevalent in those industries which use clean-in-place systems.

In many such known return pump systems, solution is not completely removed from the vessel to be cleaned, and thus is not fully returned to the cleaning system. In an ideal arrangement, the vessel which is being cleaned should be kept free of standing liquid during the rinse and cleaning cycles to maximize the removal of soil and contaminating materials. However, in such systems, sufficient solution level must be maintained in the vessel in order to provide adequate prime for the pump. Thus, in such return pump systems, the solution level in the tank cannot be kept sufficiently low to maximize vessel cleaning. Moreover, after the return pump is stopped, some solution remains in the vessel. This remaining solution may carry into the next step of the clean-in-place cycle and effectively recontaminate the cleaned vessel.

Eductor pump systems, such as that disclosed in the aforementioned U.S. Patent to Welch, are effective in providing sufficient flow return from the vessel being cleaned. However, other problems may arise associated with the retention of soil in such motive tank systems.

Three tank systems are designed and operated similarly, except that, in general, the additional tank provides the ability to supply an acid or a caustic solution to the vessel, as required for a particular application. In some three tank systems, one of the hanks may be used to store the final rinse solution from a cleaning cycle to be used as the initial rinse for a subsequent cleaning cycle. In some known three tank system, a single wash solution is used, and the final rinse from one cycle is saved and used as an initial rinse for a subsequent cycle.

Clean-in-place systems are cost effective. Operating time for the clean-in-place system, and down-time for the process system are minimized because such clean-in-place systems are permanently installed to the processing system. Moreover, such clean-in-place systems provide superior results as compared to manual cleaning. Nevertheless, there are some disadvantages associated with presently used clean-in-place systems.

Additionally, operating costs for multi-tank clean-in-place systems can be high. Such operating costs include the cost of chemical cleaning agents which can be particularly high for systems which tend to dilute or lose cleaning agent inventory. Moreover, the loss of solution due to ineffective return flow can significantly increase the cost of operating such systems.

In addition, as previously discussed, known clean-in-place systems do not provide a low cost, effective method for increasing the quality of the return solution. As discussed above, there are problems associated with soil retention within motive pump systems, which may later be transferred to the vessel being cleaned when switching from the rinse mode to the cleaning mode.

Thus, there continues to be a need for a return pump system for use with clean-in-place system which return pump system allows for the release of large amounts of air from the recirculation loop, while returning high quality solution to the system for later use, and which is self-cleaning. Such return pump system minimizes the amount of standing water in the vessel to be cleaned, thereby cleaning the vessel in a cost efficient and sanitarily effective manner, and retains a minimum amount of such soil within the components of the system needed for cleaning the vessel, when switching from a rinse mode to a cleaning mode of operation.

SUMMARY OF THE INVENTION

A return pump system for in place cleaning of an associated vessel, in conjunction with a clean-in-place system includes a recirculation loop including a return pump, an eductor, and a separator. The return pump is arranged to discharge a liquid through the eductor into the separator and is supplied with a substantially continuous flow of liquid from the separator. A return line provides flow communication between the vessel to be cleaned and the eductor at an eductor suction port. The separator has a top discharge port and a bottom discharge port. The top discharge port is configured to discharge a liquid or a liquid-air mixture therefrom.

The return pump causes liquid flowing through the recirculation loop at the eductor to have sufficient dynamic head to draw liquid or a mixture of the liquid and air from the vessel through the return line, into the eductor. The eductor discharges the liquid or liquid-air mixture into the separator. The bottom discharge port of the separator provides the substantially continuous flow of liquid to the return pump, and substantially all of the air and a portion of the liquid is discharged from the separator top discharge port at a flow rate sufficiently high to maintain a flow of liquid across the bottom of the vessel to maintain the liquid therein in a state of substantially continuous flow. The liquid is discharged from the separator top discharge port at a rate of flow about equal to the rate of flow of liquid supplied to the vessel through the supply line.

In preferred embodiment, the separator includes a tangential inlet port to impart a swirling motion to the inflowing liquid to effect efficient separation of the liquid and air. In a most preferred embodiment, the separator includes a tangential bottom discharge port 38. The tangential ports 34, 38 reduce the losses due to flow resistance and facilitate maintaining high velocities through the separator 20.

A method of in place cleaning of an associated vessel includes providing a self-cleaning return pump system, supplying a quantity of liquid to the vessel, at a predetermined flow rate, through the supply line. Pumping a liquid through the recirculation loop, creating a negative pressure at the return line. Drawing substantially all of the liquid and a mixture of air from the vessel through the return line, into the recirculation loop at the eductor and into the separator. Discharging liquid or a liquid-air mixture from the separator top discharge port, the liquid or liquid-air mixture being drawn from the vessel through the eductor, and being discharged in an amount about equal to the liquid supply to the vessel. Discharging at least a portion of the liquid from the separator bottom discharge port for supplying liquid to the return pump.

Other features and advantages of the present invention will be apparent from the following detailed description, the accompanying drawings, and the appended claims.

DETAILED DESCRIPTION OF THE PREFERRED EMBODIMENTS

Figure 1:
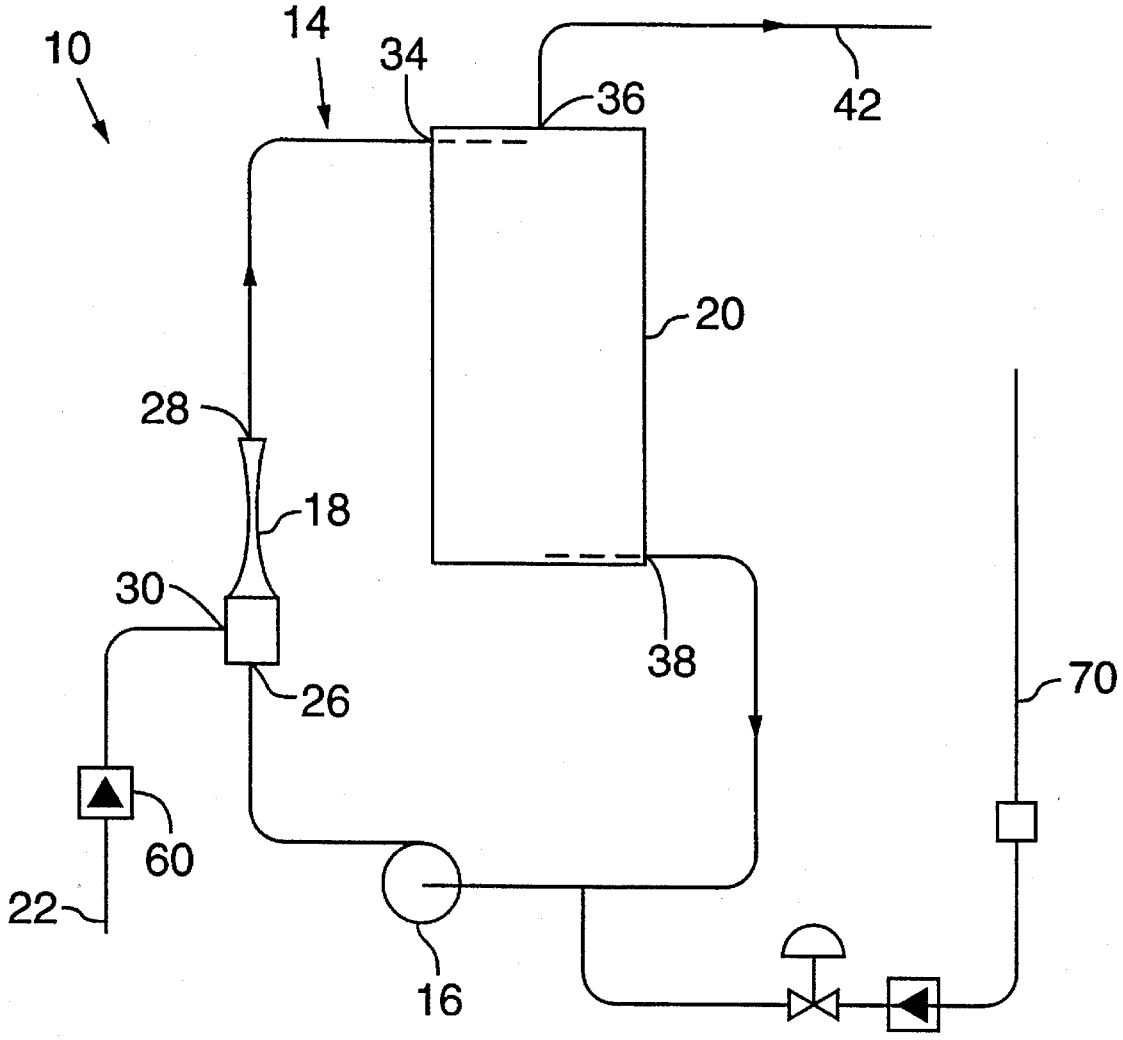
FIG. 1 is a flow diagram illustrating a return pump system, in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 2:
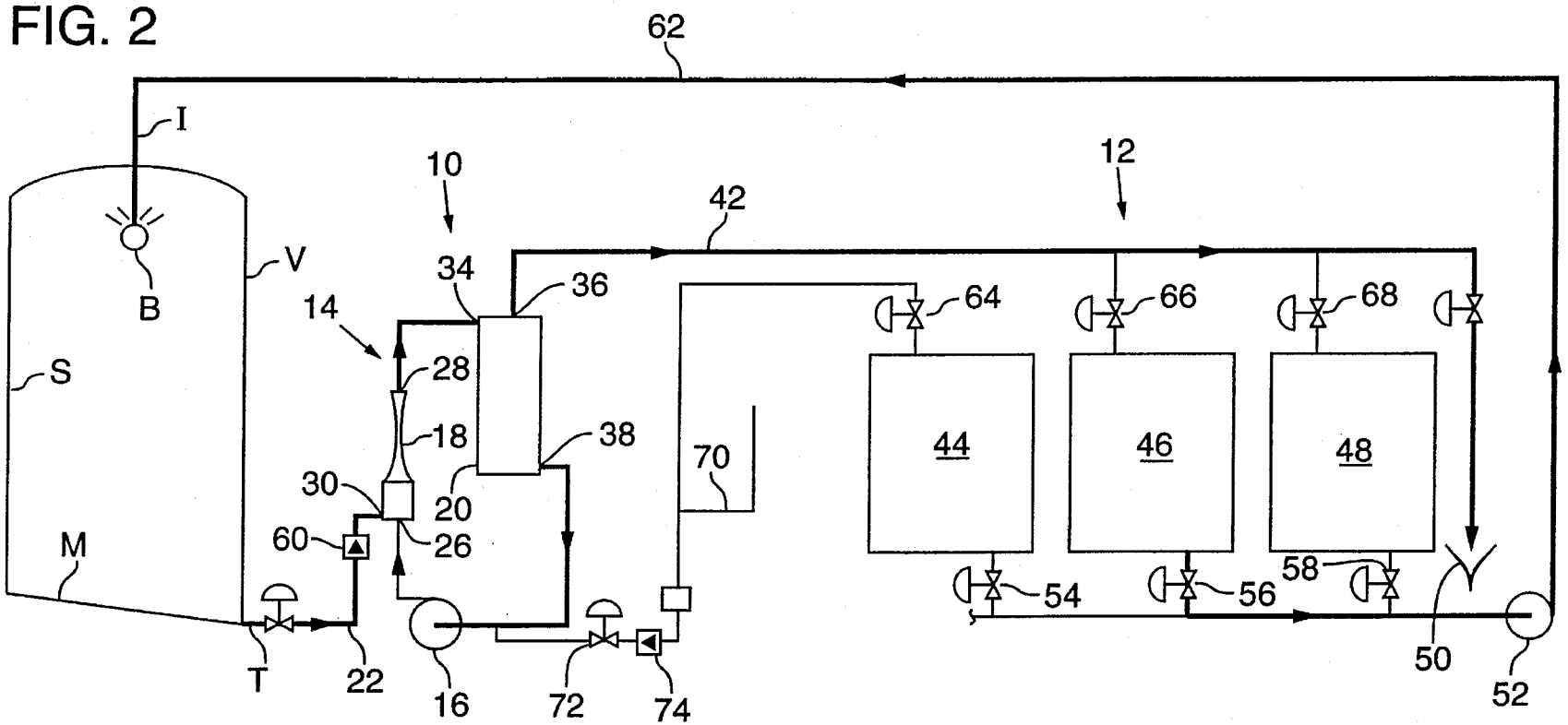
FIG. 2 is a simplified flow diagram of an exemplary three tank clean-in-place system, illustrated with the return pump system of FIG. 1, the clean-in-place system shown operating in the initial or first rinse mode, the flow path of liquid through the systems being shown in dark lines.

Referring now to FIG. 1, there is shown an embodiment of the return pump system 10 for use with a clean-in-place ("C-I-P") system 12, the tandem operation of which is best seen in FIGS. 2—2. The return pump system 10 is configured to operate with the C-I-P system 12 to clean a vessel V, such as that illustrated in FIGS. 2–4.

The vessel includes an inlet line I, through which is fed a cleaning solution or a rinse solution, and an outlet line T through which the liquid fed to the vessel V is removed. The vessel V has sides S and a bottom M, across which the cleaning or rinse liquid flows when the C-I-P system is in operation. The exemplary vessel V is also shown with an option spray ball B which facilitates the distribution of liquid from the inlet line I. In a typical arrangement, the outlet line T is positioned at about the bottom M of the vessel V. In other known arrangements (not shown), the outlet line T may include enter the vessel V at a location above the bottom M and may have a loop or other section which extends to the vessel V bottom M.

The return pump system 10 includes generally a return recirculation loop 14 having a return pump 16, an eductor 18 and a separator 20. The loop 14 provides flow communication from the pump 16 which discharges into the eductor 18, which in turn discharges into the separator 20. The separator 20 provides a supply of liquid to properly feed the pump 16.

The vessel V outlet line T is in flow communication with a return line 22 which provides flow from the vessel V to the loop 14 at the eductor 18, through an eductor suction port 24. An explanation of the operation of the eductor 18 is provided in the aforementioned U.S. Pat. No. 5,392,797 to Welch, which patent is incorporated herein by reference.

In a typical arrangement, the eductor 18 has three ports, namely, an inlet port 26, an outlet port 28 and a suction port 30. In the present configuration of the return pump system 10, the inlet port 26 is provided with flow from the pump 16. The liquid exits from the eductor 18 at the outlet port 28. The return line 22 which is in flow communication with the vessel V provides a flow path for the eductor 18 to draw liquid or a mixture of liquid and air from the vessel V.

The eductor 18 discharges into the separator 20. An exemplary separator 20 has three ports, an inlet port 34, a top discharge port 36 and a bottom discharge port 38. The liquid or liquid-air mixture enters the separator at the inlet port 26, which in a preferable arrangement is a tangentially oriented port, positioned near the top of the separator 20. The tangential port 34 arrangement imparts a swirling motion to the inlet stream which facilitates separation of the entering stream. The bottom discharge port 38 may also be tangentially configured to minimize losses due to flow resistance in the separator 20 and to maintain relatively high flow velocities therein.

A solid liquid stream exits the separator 20 from the bottom discharge port 38, which is routed to the pump 16 inlet. The top discharge port 36 may discharge a solid liquid stream, an air stream, or a mixture of liquid and air, depending upon the mode of operation of the system 10, which modes of operation will be described in further detail herein.

Figure 3:
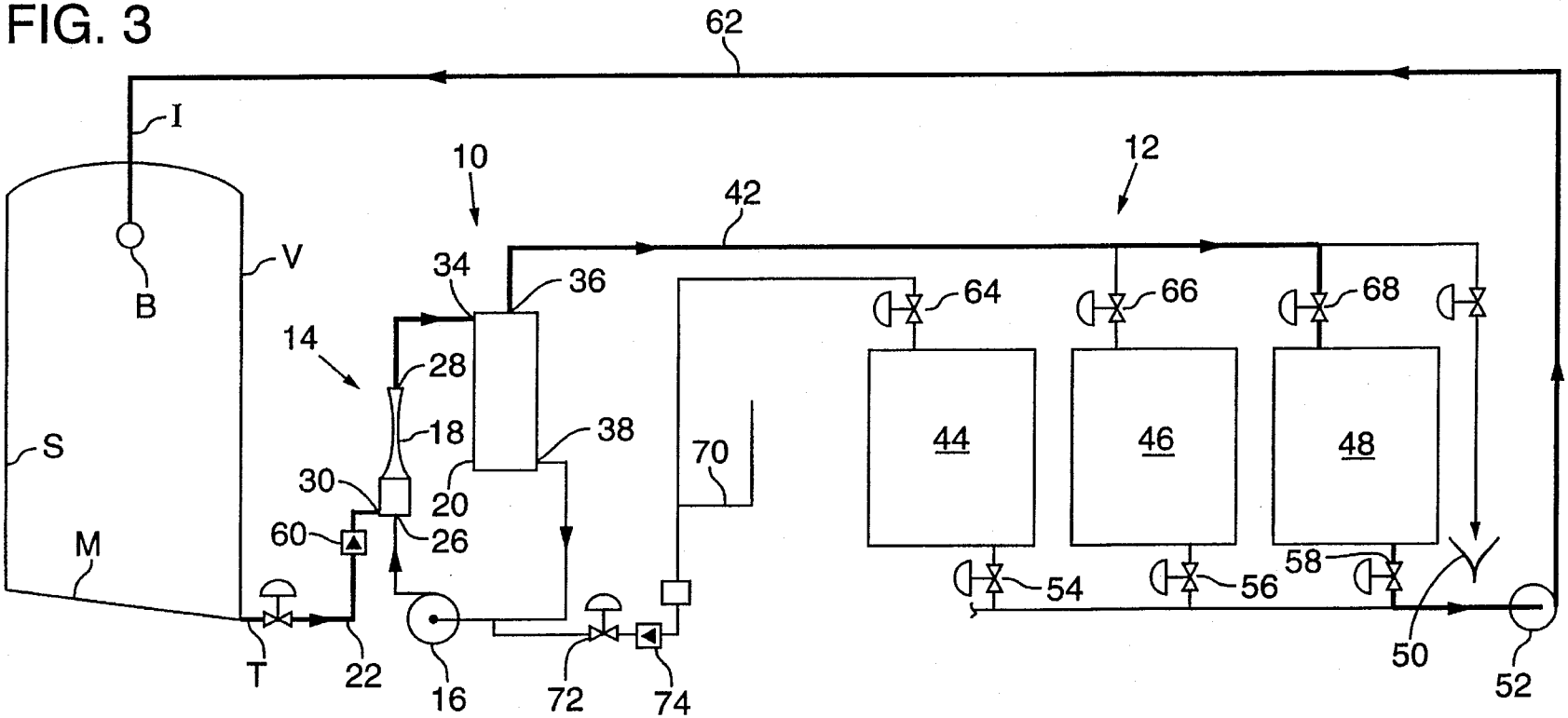
FIG. 3 is a simplified flow diagram similar to FIG.2, with the clean-in-place system shown operating in the wash recirculation mode, the flow path of liquid through the systems being shown in dark lines.
Figure 4:
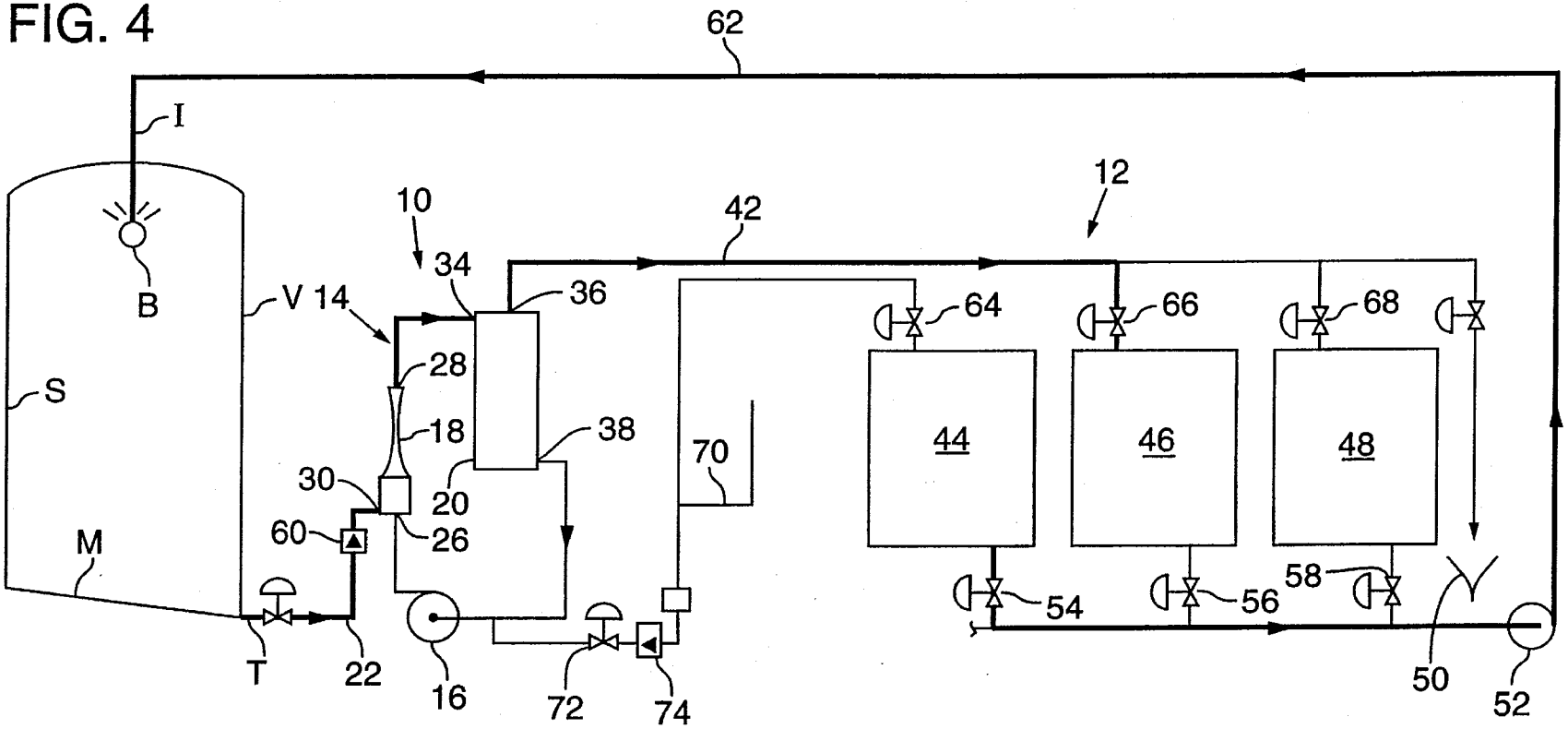
FIG. 4 is a simplified flow diagram similar to FIG.2, with the clean-in-place system shown operating in the final rinse mode, the flow path of liquid through the systems being shown in dark lines.

The top discharge port 36 is in flow communication with the C-I-P system 12, as illustrated in FIGS. 2–4, by a transfer line 42. The exemplary C-I-P system 12 includes three tanks, a rinse tank, 44, a rinse recovery or recovery tank 46, and a wash tank 48. A drain 50 may also be considered a part of the C-I-P system 12.

It will be recognized by those skilled in the art that the C-I-P system 12 illustrated is exemplary and may include different or other components, including but not limited to additional or fewer tanks, pumps, heaters, instrumentation and the like. The C-I-P system 12 and the return pump system 10 may have a clear water feed line 70, such as that illustrated, to provide a source of fresh feed water to the systems 10, 12, and to provide priming liquid to the systems 10, 12.

In one configuration, a supply pump 52 provides the motive force to the supply the vessel V with solution from the tanks 44, 46, 48. Various valves may be placed in the systems 10, 12 to facilitate isolation and operation of the various components, exemplary of which are discharge valves 54, 56 and 58, which valves are associated with the discharge side of the rinse, recovery and wash tanks, 44, 46 and 48, respectively. Inlet valves 64, 66 and 68 are positioned at the rinse, recovery and wash tanks, 44, 46 and 48, at the respective inlets. In a most preferred arrangement, a check valve 60 is located in the return line 22, between the vessel V and the eductor 18 to prevent back flow from the return pump system 10 to the vessel V, when the return pump system 10 is not running.

The operation of the return pump system 10 will now be described with reference to FIGS. 2–4, which illustrate exemplary three tank C-I-P system in its various modes of operation. FIG. 2 illustrates the return pump and C-I-P systems 10, 12 operating in the initial rinse mode, FIG. 3 illustrates the return pump and C-I-P systems operating in the wash recirculation mode, and FIG. 4 illustrates the return pump and C-I-P systems operating in the final rinse mode.

In the initial rinse mode, illustrated in FIG. 2, the vessel is supplied with liquid from the recovery,tank 46, which may be the final rinse solution of a previous cleaning cycle. The feed solution is pumped to the vessel V through a vessel feed line 62 from the supply pump 52. Contemporaneous with the supply to the vessel V, the return pump system 10 is initiated, by providing power to the return pump 16. It may be necessary to provide a liquid stream to the return pump 16 in order to provide the pump with adequate prime. In such an instance, a prime line 70 may be used to provide such a prime. The prime line 70 may include a control valve 72 and a check valve 74, and may also be used to provide a clear water source to the tanks 44, 46 and 48.

The return pump 16 circulates the solution through the recirculation loop 14, through the eductor 18 and the separator 20. The recirculation loop 14 draws the feed solution from the vessel V through the eductor 18 and the return line 22. At the separator 20, the inlet stream may be a mixture of liquid and air, if air is drawn from the vessel V. In this instance, the inlet stream is separated into a solid stream of liquid which is discharged from the bottom discharge port 38, which in turn is routed to the return pump 16 inlet. In this manner, the return pump is precluded from having air introduced into the pump 16.

It will be recognized by those skilled in the art that effective cleaning of the vessel V will occur when the liquid or solution fed to the vessel V is kept flowing across the sides S and bottom M of the vessel and when pooling in the bottom M of the vessel is minimized or eliminated. As such, the present return pump system is configured to operate with the eductor drawing liquid, a mixture of air and liquid, or even drawing air alone, from the vessel V through the return line 22. Advantageously, the volume of liquid in the recirculation loop 14 is sufficient to maintain a solid stream of liquid being fed to the return pump 16 for proper pump suction head.

The amount of liquid in the flow cleaning loop will be determined by the overall characteristics, such as the volume of the system 10, the vessel V surface area, the feed line 62 and the return line 42. The amount of liquid will be self-regulated by the return pump system 10 to maintain a steady flow of liquid over the sides S and bottom M of the vessel V. The appropriate liquid flow rate will be established by the supply pump 52 and the inlet system flow restrictions. The optimum liquid flow in the vessel V, and more specifically across the bottom M and sides S of the vessel V will be controlled by the return system 10 removing liquid and air from the outlet T, thereby maintaining all of the liquid in the vessel V in a constant state of flow. The total liquid inventory in the C-I-P flowing loop is held to an optimum minimum by the ability of the return pump system 10 to return more volume (i.e., air and liquid) than the supply to the vessel V. Essentially, the system 10 draws liquid from the vessel V and both returns liquid to the return pump 16 and discharges liquid to the C-I-P system 12.

With pooling of liquid in the vessel V kept to a minimum, a stream of air or liquid-air mixture is discharged from the separator top discharge port 36. In the illustrated return pump system 10, the separator top discharge is routed to a drain 50 for storage or other appropriate waste treatment process. It will be recognized by those skilled in the art that the liquid which is returned from the vessel during the initial period of the initial rinse mode may be heavily loaded with contaminants or soil. It is of utmost importance to discharge the sludge from the return pump system 10 in order to prevent any carryover into the next operating mode, the wash recirculation mode. In this regard, the present return pump system 10 is self cleaning.

The system is configured such that the velocity of liquid through the recirculation loop 14 and the separator are sufficiently high to drive the sludge from the separator out through the top discharge port 36. It is anticipated that the sludge will be discharged to a drain 50 or other appropriate waste processing system. The system 10 is also configured such that the residence time $t_r$ of liquid in the separator 20, that is, the ratio of the wetted volume of the separator 20 (that portion of the separator 20 which filled) to the flow rate of liquid through the separator 20 is sufficiently small to prevent accumulation of sludge.

In a current embodiment of the system, the flow rate through the separator is in a range of about 200 to about 300 gallons per minute (gpm), preferably about 250 gpm, with a wetted separator volume of about 8 gallons, which results in a residence time $t_r$ in a range of about 1 to 3 seconds. Thus, because of the short residence time, and the high rotational velocity of the liquid, the sludge does not have the opportunity to accumulate in the separator 20 and is essentially washed out to the C-I-P system 12 and preferably to the drain 50. During the initial rinse mode, the recirculation loop 14 is essentially operated in a flooded state, with velocities at the separator inlet of about 10 to about 20 feet per second.

When the initial rinse mode is complete, the C-I-P system 12 is operated in the wash recirculation, which is illustrated in FIG. 3. In the wash mode, solution is fed to the vessel V from the wash tank 48 by use of the supply pump 52. The return pump system 10 operates in much the same manner as the initial rinse mode, however, the liquid which is discharged from the separator top discharge port 36 is returned to the wash tank 48, and will typically be recirculated through the vessel V.

It is contemplated that flow rates during the wash mode will be about the same as those during the initial rinse mode, in a range of about 200 to 300 gpm, preferably about 250 gpm, with a wetted separator 20 volume of about 8 gallons.

When the wash recirculation mode is complete, the C-I-P and return pump systems 12, 10 are operated in the final rinse mode, illustrated in FIG. 4. In the final rinse mode, the return pump system 10 is operated in much the same manner as it is operated in the initial rinse and wash recirculation modes, with about the same flow rates, except that the liquid or liquid-air mixture which is discharged from the separator 20 top discharge port 36 is directed to the rinse recovery tank 46. The solution in the rinse recovery tank 46 may be reserved and stored for later use as an initial rinse in a subsequent cleaning cycle.

The present return pump system 10 advantageously provides an effective and efficient method of in place cleaning of a process vessel V, in conjunction with a C-I-P system 12.

The vessel V is supplied with a liquid, such as a cleaning solution or rinse solution through the vessel feed line 62. As discussed herein, the recirculation loop 14 is started by, for example, priming and initiating the return pump 16. As the liquid flows through the recirculation loop 14, a liquid or liquid-air mixture is drawn from the vessel V through the return line 22, into the suction port 30 of the eductor 18.

In the separator 20, substantially all of air which enters from the eductor 18 will be separated from the liquid stream, and the air or a mixture of air and liquid will be discharged from the separator 20 top discharge port 36 and directed to the appropriate tank or drain 44, 46, 48, 50 within the C-I-P. A solid stream of liquid is discharged from the separator bottom discharge port 38 to provide adequate feed and pump suction head for the return pump 16. The amount of liquid which is discharged from the separator top discharge port 36 is about equal to the amount of solution which is fed to the vessel V through the vessel feed line 62.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A self-cleaning return pump system for use with a clean-in-place system for cleaning vessels, the vessel having a bottom wall, a supply line and a return line and being supplied with a liquid through the supply line, the system comprising:

a recirculation loop for providing flow communication including a return pump, an eductor, and a separator, the return pump being arranged to discharge a liquid through the eductor into the separator and being supplied with a substantially continuous flow of liquid from the separator, the return line providing flow communication between the vessel to be cleaned and the eductor, the separator having an upper discharge port and a lower discharge port, the upper discharge port being positioned above the lower discharge port and being configured to discharge one of a liquid and a liquid-air mixture therefrom, wherein the return pump causes liquid flowing through the recirculation loop at the eductor to have sufficient dynamic head to draw one of the liquid and a mixture of the liquid and air from the vessel through the return line, into the eductor and into the separator, wherein the lower discharge port of the separator provides the substantially continuous flow of liquid to the return pump and wherein substantially all of the air and a portion of the liquid is discharged from the separator upper discharge port at a flow rate sufficiently high to maintain a flow of liquid across the bottom wall of the vessel to maintain the liquid therein in a state of substantially continuous flow, and wherein the liquid is discharged from the separator upper discharge port at a rate of flow about equal to the rate of flow of liquid supplied to the vessel through the supply line.

2. The return pump system of claim 1 including means for priming the return pump.

3. The return pump system of claim 2 wherein the priming means includes a line for providing a priming liquid to the return pump.

4. The return pump system of claim 1 wherein the separator includes a tangential inlet port.

5. The return pump system of claim 1 including a check valve in the return line positioned intermediate the vessel and the eductor to prevent back flow from the recirculation loop to the vessel.

6. A self-cleaning return pump system for in place cleaning of a vessel, the vessel having a bottom wall and side walls extending upward from the side wall, and being supplied with a quantity of solution at a predetermined flow rate, the vessel including a return line in flow communication with the return pump system, the return pump system comprising:

a recirculation loop including a motive return pump, an eductor and a separator, the return pump being in flow communication with the eductor, the eductor having an inlet port, an outlet port and a suction port in flow communication with the return line, the separator having an inlet port, an upper discharge port and a lower discharge port, the return pump being configured to discharge into the eductor inlet port, and the eductor outlet port being configured to discharge into the separator inlet port, wherein the return pump causes a flow of liquid in the recirculation loop to have sufficient dynamic head to draw at least a portion of the solution supplied to the vessel through the return line into the eductor at the suction port, the separator discharging at least a portion of the liquid therefrom through the lower discharge port to the return pump, and further discharging at least a portion of the liquid therefrom through the upper discharge port, the liquid discharged from the upper discharge port being in an amount about equal to the flow rate of solution supplied to the vessel.

7. The self-cleaning return pump system of claim 6 wherein the liquid in the recirculation loop has a residence time in the separator in a range of about 1 to about 3 seconds.

8. The self-cleaning return pump system of claim 6 including a transfer line extending from the separator upper discharge port to one of an associated storage and process tanks for transferring the top discharge therefrom to one of the associated storage and process tanks.

* * * * *